United States Patent [19]

Selmer

[11] Patent Number: 4,701,978

[45] Date of Patent: Oct. 27, 1987

[54] HINGE PIN GUIDE, ESPECIALLY FOR MUSICAL INSTRUMENTS

[75] Inventor: Jean Selmer, Paris, France

[73] Assignee: Jacques Selmer, Paris, France

[21] Appl. No.: 867,472

[22] Filed: May 27, 1986

[30] Foreign Application Priority Data

Jun. 3, 1985 [FR] France ..... 85 08335

[51] Int. Cl.[4] ..... E05D 5/12

[52] U.S. Cl. ..... 16/380; 16/386; 16/340

[58] Field of Search ..... 16/257, 380, 340, 242, 16/381, 386; 251/297; 84/380 R, 382, 384, 385 R

[56] References Cited

U.S. PATENT DOCUMENTS 3,394,624 7/1968 Seaman ..... 84/382

FOREIGN PATENT DOCUMENTS 334271 1/1936 Italy ..... 16/340

548505 9/1956 Italy ..... 84/380

*Primary Examiner*—Nicholas P. Godici

*Assistant Examiner*—G. M. Reid

*Attorney, Agent, or Firm*—Lackenbach Siegel Marzullo & Aronson

[57] ABSTRACT

This pin guide is mounted on the end of a rotatable rod (1) of the key mechanism of a musical instrument. The rod has at its end a cylindrical bore (17) receiving a spring means (19) and a rotary pivot piece (9) capable of sliding in said bore. The pivot piece (9) has at its outer end a cutout (15) which coaxially receives the tip (13) of a pointed screw (7) screwed into the body of a hinge support ball (3).

7 Claims, 2 Drawing Figures

HINGE PIN GUIDE, ESPECIALLY FOR MUSICAL INSTRUMENTS

This invention relates to a hinge pin, especially for a musical instrument, and more particularly for a saxophone, or a musical instrument with a similar key mechanism.

It is known, in fact, that the main keys of such an instrument may each operate up to some 1,000,000 times a year in the hands of a professional. In the long run, such frequent use causes wear at the hinge pins of the keys, and consequently a play or slackness which translates into loss of tightness and an additional noise of operation of the keys which both adversely affect the quality of sound. This defect is noticed especially in sound recordings, where the receiving microphone is close to the playing instrument.

Until now the guiding of hinge pins of saxophone keys was done by means of a screw inserted in the end guide of each of these pins and comprising a ferrule playing the role of hinge spindle. This design leads to the aforementioned shortcomings making it necessary to take up the play (clearance, slack) by manual tighting of the screw, a delicate operation for this kind of instrument.

The present invention aims at remedying these shortcomings and proposes a hinge pin guide, notably for a key mechanism of a musical instrument, making use of a rotatable rod actuated by a hand lever and elastically brought back to a position of rest by a spring, and a hinge support of said rod, characterized in that the rod has at its end a cylindrical bore receiving a spring means and a rotary pivot spindle piece adapted to slide in said bore, said piece having at its outer end a cutout which receives coaxially the tip of a pointed screw screwed into the body of said hinge support.

The result of this arrangement is that, on the one hand, the play (clearance) of the rod is controlled positively under the action of the spring means, which consists advantageously of a simple helical spring. This play is thus taken up automatically. On the other hand, the rotary movement is guided by means of the rotary pivot piece. This pivot is cylindrical and has a diameter substantially equivalent to that of said bore and can slide with very little play in the bore of said rod. On the side of the opening of the bore of the rod, the pivot is provided with a conical internal cutout which may be extended by a coaxial perforation going through or not (blind hole). This cutout receives the tip of the pointed screw, the tip being advantageously of ogival form, to facilitate the sliding of the surfaces in contact. When wear occurs, the point of the screw penetrates freely into said perforation and thus does not hinder the progress of the take-up of wear. The pointed screw may be of stainless steel and the pivot of copper alloy, as this imparts to the sliding surfaces an ability of self-lubrication which reduces friction and hence wear.

This hinge guide thus constitutes, for the mechanism of the keys of the instrument, a permanently installed part which it is not necessary to adjust, assuring a constant rotary guiding of said keys, of high quality.

The invention will now be described with the aid of an example and with reference to the annexed drawings, in which.

Figure 1:
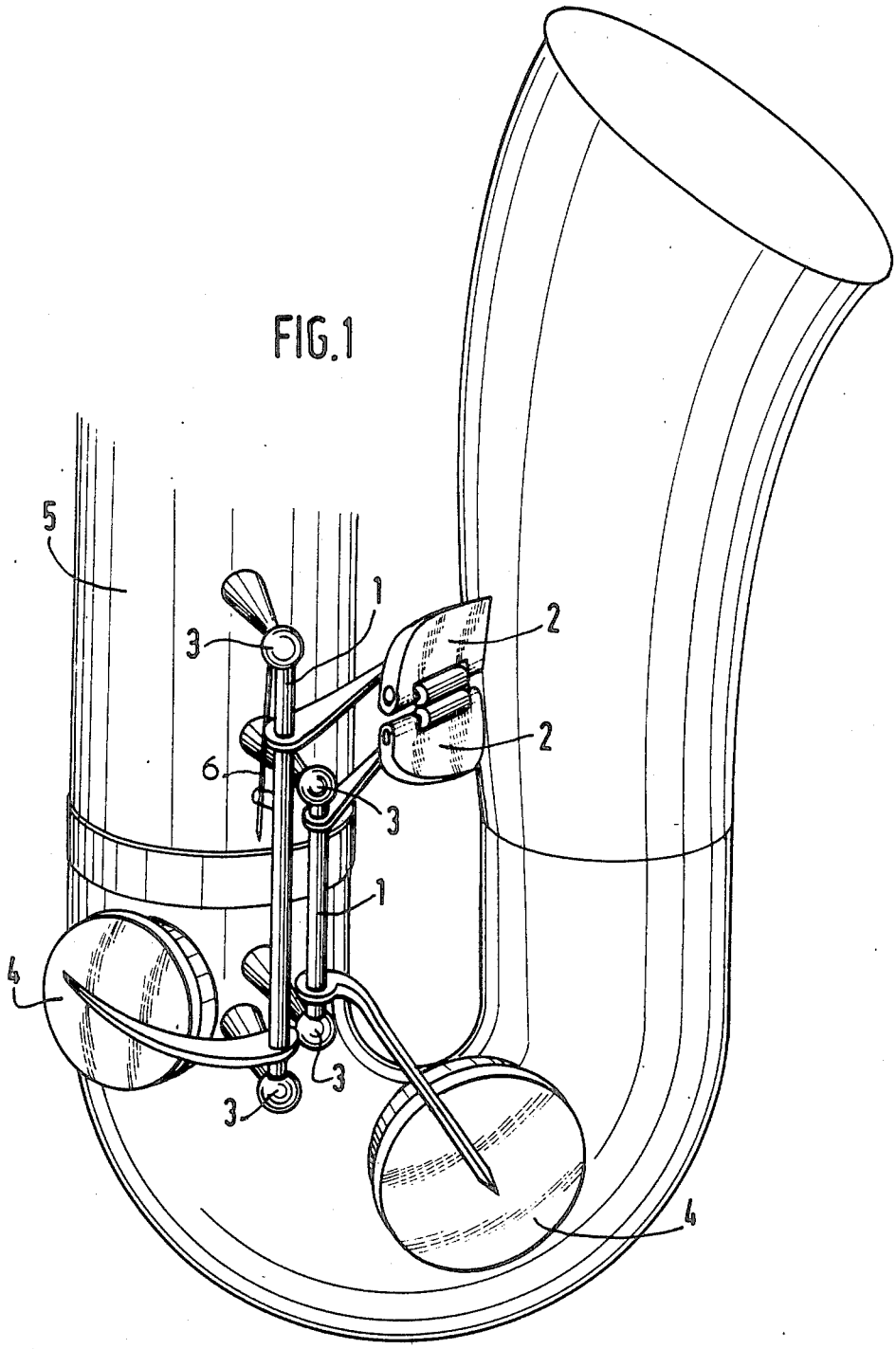
FIG. 1 is a view of a hinge rod of a key mechanism of a saxophone.
Figure 2:
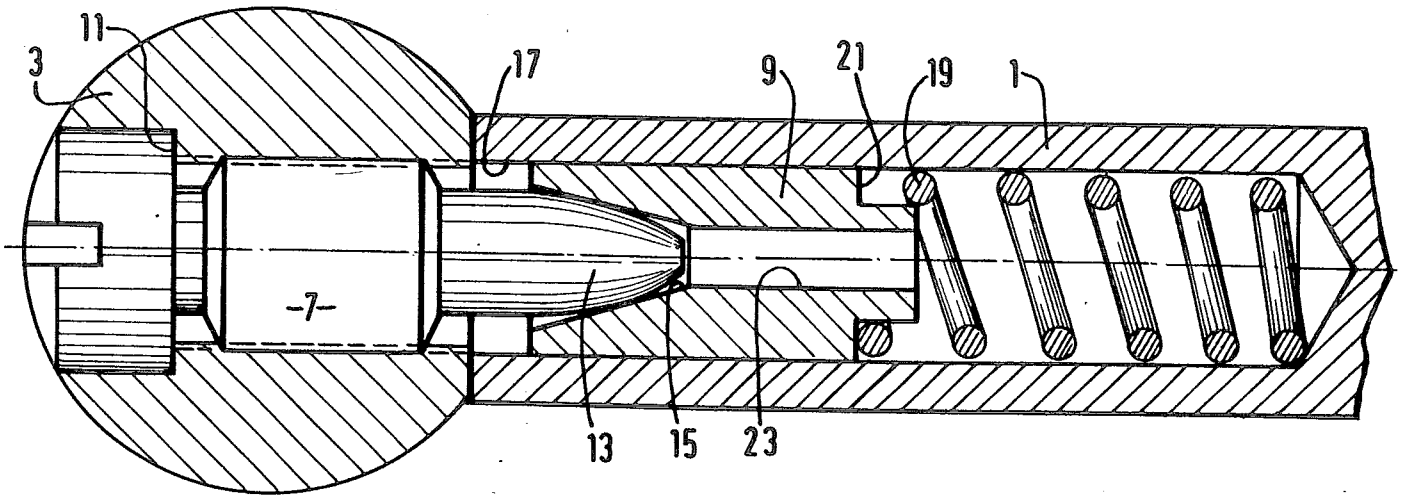
FIG. 2 is a view in section of the hinge pin guide of this rod.

As represented in FIGS. 1 and 2, the hinge rods 1 of the keys of the saxophone are carried at their end by hinge support balls 3, integral with the body 5 of the instrument, and are elastically held in a rest position by a spring 6. These rods 1, each driven by a lever 2 and controlling the opening of a valve 4, are guided in rotation at support balls 3 following (according to) a hinge guide assembly using a pointed screw 7 cooperating with a pivot 9 elastically urged toward the point of said screw. The pointed screw 7 is screwed into a tapping inside the ball. It is screw-locked by application of its head against an adequate shoulder 11 provided in the body of the ball. On the opposite side there emerges the ogival tip 13 of the screw 7, which (tip) is applied against an axial conical cutout 15 formed inside the pivot piece 9 disposed inside a bore 17 formed at the end of the rod 1. This pivot piece is cylindrical and has a diameter equivalent to that of the end bore 17 of the rod, so as to slide with very little play on the inside; furthermore, a helical spring 19 supported at one end on the bottom of the bore of the rod, and acting by its other end on a shoulder 21 formed at the end of the pivot piece 9, urges the latter against the tip 13 of the pointed screw. A through hole 23 inside the pivot piece receives the point of the tip of the pointed screw, in proportion to the wear of the sliding surfaces of the ogival tip of the screw on the conical cutout of the pivot piece.

The pointed screw 7 is of stainless steel, while the pivot piece 9 is of brass. Thereby the rotation between the fixed support ball 3 and the pivot piece 9 integral in rotation with the rod 1 occurs with minimum friction and reduced wear.

This arrangement thus described shows the desirability of the guide according to the invention which, by its automatic compensation of wear, assures a perpetual rotary guiding of the rod with practically no play whatever.

I claim:

1. In a mechanism comprising a hinge pin in the form of a cylindrical rod which is axially rotatable by a hand lever, said rod being rotatably supported at least at one end thereof in a hinge support member, an improved hinge pin guide consisting of:

a spring contained in an axial cylindrical bore extending within said rod from said supported end thereof;

a cylindrical pivot piece slidably contained in said bore, one end of said pivot piece being in compression contact with said spring and the other end thereof having an axially tapered frustoconical cutout therein; and a cylindrical screw, one end of which is affixed in said hinge support member and the other end of which is tapered to an ogival point, such taper fitting inside the taper of the cutout in said pivot piece, the tapered end of said screw being in contact with the tapered surface of said cutout;

whereby the compressive force exerted by said spring against said pivot piece maintains the surface of the tapered cutout therein in contact with the tapered end of said screw, preventing lateral play between said pivot piece and said screw, notwithstanding abrasive wear of such surfaces due to sliding contact there-between during repeated rotation of said hinge pin.

2. Hinge pin guide according to claim 1, characterized in that the cylindrical pivot piece has a diameter substantially equivalent to that of the bore of the rod, so as to permit its internal sliding therein with very little play.

3. Hinge pin guide according to one of claims 1 and 2 characterized in that the spring means (19) consists of a helical spring.

4. Hinge pin guide according to claim 3, characterized in that the end of said pivot piece in contact with said spring has a shoulder adapted to receive said spring.

5. Hinge pin guide according to claim 1, characterized in that the tapered screw is of stainless steel.

6. Hinge pin guide according to claim 1, characterized in that the pivot piece is of a copper alloy.

7. Hinge pin guide according to claim 1, characterized in that the pivot piece is of brass.

* * * * *